United States Patent [19]

Ueno et al.

[11] Patent Number: 4,722,879

[45] Date of Patent: Feb. 2, 1988

[54] ELECTROPHOTOGRAPHIC PHOTORECEPTOR WITH SUPER LATTICE STRUCTURE

[75] Inventors: Tsuyoshi Ueno, Fujisawa; Shuji Yoshizawa, Tokyo; Masataka Hirose, 6-4-401, Hakushimanakamachi, Naka-ku, Hiroshima-shi, Hiroshima-ken, all of Japan

[73] Assignees: Kabushiki Kaisha Toshiba, Kawasaki; Masataka Hirose, Hiroshima, both of Japan

[21] Appl. No.: 948,075

[22] Filed: Dec. 31, 1986

[30] Foreign Application Priority Data

Jan. 10, 1986 [JP] Japan ..... 61-3134

[51] Int. Cl.[4] ..... G03G 5/082

[52] U.S. Cl. ..... 430/57; 148/DIG. 60; 430/84; 430/58; 430/65

[58] Field of Search ..... 430/57, 56, 84, 65, 430/58; 148/DIG. 160

[56] References Cited

U.S. PATENT DOCUMENTS 4,544,617 10/1985 Mort et al. ..... 430/57 X
4,598,164 7/1986 Tiedji et al. ..... 148/DIG. 160

FOREIGN PATENT DOCUMENTS 0194329 9/1986 European Pat. Off. .
60-62166 4/1985 Japan .

*Primary Examiner*—J. David Welsh
*Attorney, Agent, or Firm*—Schwartz, Jeffery, Schwaab, Mack, Blumenthal & Evans

[57] ABSTRACT

A photoconductive layer of an electrophotographic photoreceptor has a super lattice structure obtained by alternately stacking thin layers (the thickness falls within the range of 30 to 200 Å) of at least two types of amorphous semiconductors having different optical band gaps. In the super lattice structure, when the layer having a narrow bandgap is sandwiched between the layers having wide bandgaps, a quantum well is formed. By the quantum effect, electrons in the well are shifted to cause high mobility of carriers. When the super lattice structure is applied to the photoconductive layer of the electrophotographic photoreceptor, the number of carriers generated at the interface between the thin layers is large. In the photoconductive layer having the super lattice structure, carrier lifetime is prolonged, in the potential well layer, 5 to 10 times that in a single layer, due to the quantum size effect, as compared with that of a single layer, thereby increasing light sensitivity of the photoconductive layer.

13 Claims, 7 Drawing Figures

ELECTROPHOTOGRAPHIC PHOTORECEPTOR WITH SUPER LATTICE STRUCTURE

BACKGROUND OF THE INVENTION

The present invention relates to an electrophotographic photoreceptor for electrophotography.

Amorphous silicon containing hydrogen H (to be referred to as a-Si:H hereinafter) has received a great deal of attention as a photoconductive material, and has been used in a variety of applications in solar cells, thin film transistors, image sensors, and electrophotographic photoreceptors.

The materials used as the photoconductive layers in conventional electrophotographic photoreceptors can be categorized as inorganic (e.g., CdS, ZnO, Se, or Se-Te) and organic (poly-N-vinylcarbazole (PVCZ) or trinitrofluorene). The a-Si:H has many advantages over the above-mentioned conventional organic and inorganic materials, in that it is non-toxic and does not require recovery, high spectral sensitivity in the range of visible light is guaranteed, and high surface hardness ensures high resistance to wear, and good anti-impact properties. For this reason, a-Si:H is receiving a great deal of attention as a promising electrophotographic photoreceptor.

The a-Si:H material has been developed as an electrophotographic photoreceptor on the basis of the Carlson system. In this case, good photoreceptor properties mean high dark resistance and high sensitivity to light. However, it is difficult to incorporate these two properties in a single layer photoreceptor. A barrier layer is arranged between the photoconductive layer and a conductive support, and a surface charge-retaining layer is formed on the photoconductive layer, to constitute a multilayer structure, thereby satisfying the two requirements described above.

The a-Si:H material for use as a photoreceptor is prepared by glow discharge decomposition, using a silane gas. During the fabrication process, hydrogen is incorporated in the a-Si:H film, whereby the electrical and optical characteristics thereof are changed greatly according to the change in content of hydrogen. As the amount of hydrogen incorporated in the a-Si:H film increases, the film's optical bandgap widens and its resistance increases. Along with the increase in resistance, the sensitivity to light having long wavelengths is degraded. Therefore, it is difficult to use such an a-Si:H film in a laser beam printer utilizing a semiconductor laser. When the content of hydrogen in the a-Si:H film is high, as described above, most of the components in the film can be those having bonding structures, such as $(SiH_2)_n$ and $SiH_2$, depending on film formation conditions. In this case, the number of voids and hence, the number of silicon dangling bonds, increases, thereby degrading the photoconductive characteristics of the film. Under these circumstances, the film cannot be used as an electrophotographic photoreceptor. However, when the content of hydrogen in the a-Si:H film is low, the optical bandgap is narrow and the resistance lower. As a result, the sensitivity to light having short wavelengths is increased. A small content of hydrogen causes bonding of hydrogen atoms with the silicon dangling bonds, thus reducing the number of the silicon dangling bonds. For this reason, the mobility of photocarriers is degraded, thereby shortening their lifetime. At the same time, the photoconductive property of the film is degraded and the film cannot be used as an electrophotographic photoreceptor.

SUMMARY OF THE INVENTION

It is an object of the present invention to provide an electrophotographic photoreceptor wherein a large number of photocarriers can be generated upon radiation, the lifetime of the photocarriers can be long, a wide sensitivity range from visible light range to a near-infrared range can be guaranteed, and good environmental resistance property can be obtained.

An electrophotographic photoreceptor according to the present invention comprises a conductive substrate and a photoconductive layer having a super lattice structure for generating carriers upon light radiation.

The super lattice structure is defined as a structure obtained by stacking thin (200 Å or less) amorphous semiconductor films. The super lattice structure has properties which are not inherent to a single amorphous semiconductor layer. In such a structure, the carrier lifetime can be prolonged, in a potential well layer, to 5 to 10 times that in a single layer, due to the quantum size effect. The number of photocarriers generated at an interface between the adjacent thin layers in greater than that in a single layer, and high sensitivity to light can be obtained.

In this super lattice structure, thin layers having different optical bandgaps may be alternately stacked, to preferably obtain a heterojunction between the thin films. Therefore, the electrophotographic properties of the photoreceptor can be further improved.

DETAILED DESCRIPTION OF THE PREFERRED EMBODIMENTS

The characteristic feature of the present invention lies in the fact that all or part of a photoconductive layer (including a charge-generation layer in the electrophotographic photoreceptor of a function-separation type) is constituted by a super lattice structure. The super lattice structure is obtained by stacking very thin (30 to 200 Å, and preferably 100 Å or less) amorphous semiconductor layers. In such a structure, it is preferable to stack amorphous semiconductor layers having different optical bandgaps. The thin films constitute a heterojunction.

Examples of the material for forming such a thin film are a-Si:H having an optical bandgap of 1.75 eV; a-SiN:H, a-SiC:H, and a-SiO:H, each of which has an optical bandgap of 1.9 eV; or a-SiGe:H, a-GeN:H, a-GeC:H, and a-GeO:H (where a-Ge is amorphous germanium), each of which has an optical bandgap of 1.5 eV.

Figure 1:
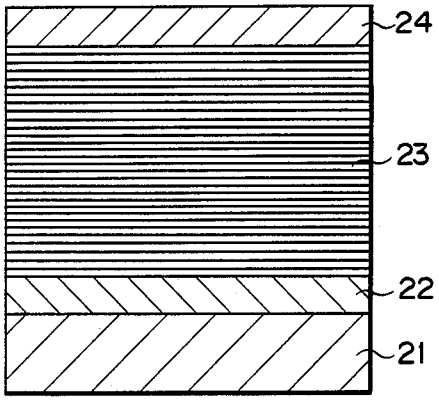
FIG. 1 is a sectional view showing an electrophotographic photoreceptor according to an embodiment of the present invention.
Figure 2:
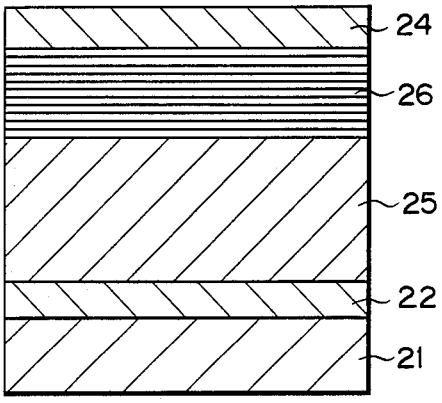
FIG. 2 is sectional view of an electrophotographic photreceptor according to another embodiment of the present invention.

FIG. 1 is a sectional view of an electrophotographic photoreceptor according to an embodiment of the present invention, and FIG. 2 is a sectional view of an electrophotographic photoreceptor according to another embodiment of the present invention.

Referring to FIG. 1, barrier layer 22 is formed on conductive substrate 21, and photoconductive layer 23 is formed on barrier layer 22. Surface layer 24 is formed on photoconductive layer 23. The electrophotographic photoreceptor shown in FIG. 2 is of a function-separation type wherein a photoconductive layer has charge-generation layer 26 and charge-transfer layer 25. Charge-transfer layer 25 is formed on conductive substrate 21 and barrier layer 22. Charge-generation layer 26 is formed on transfer layer 25, and surface layer 24 is formed on charge-generation layer 26. When light is incident on photoconductive layer 23, carriers are generated in layer 23. While carriers of one polarity are neutralized by charges on the surface of the photoreceptor, carriers of the other polarity travel through photoconductive layer 23 and reach conductive substrate 21. In the function separation type photoreceptor, (FIG. 2) when light is incident thereon, carriers are generated by charge-generation layer 26. Carriers of one polarity are neutralized by charges on the surface of the photoreceptor, and carriers of the other polarity travel through charge-transfer layer 25 and reach conductive substrate 21.

Figure 3:
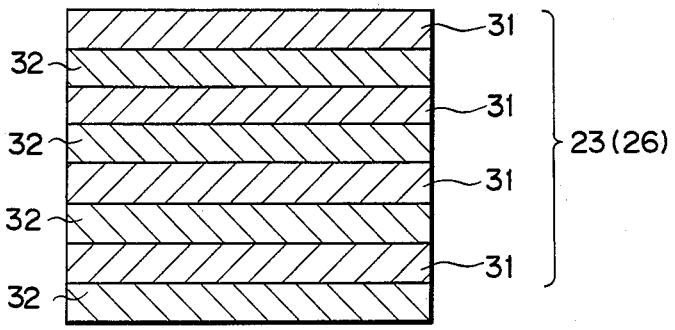
FIG. 3 is an enlarged view of part of each of the photoreceptors shown in FIGS. 1 and 2.
Figure 5:
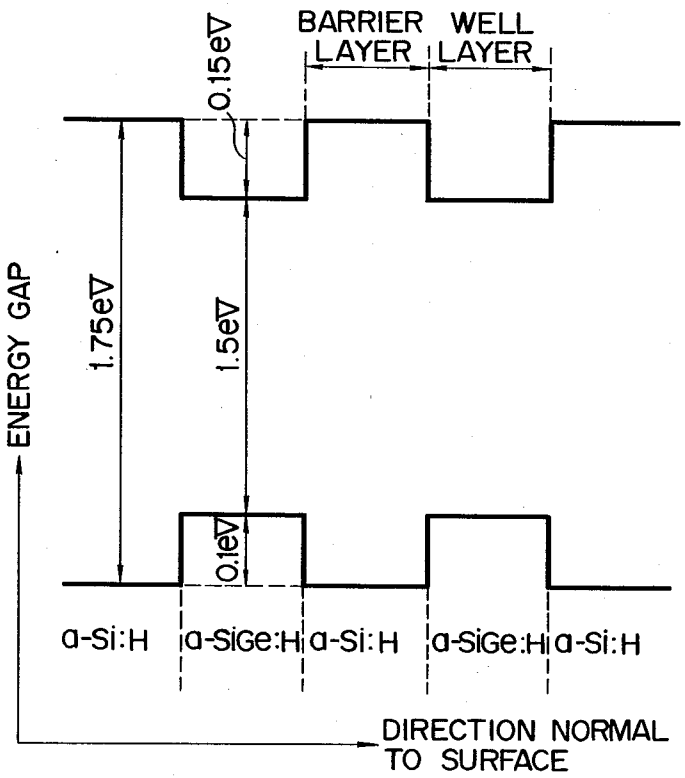
FIGS. 4 and 5 are graphs showing energy bands of super lattice structures.
Figure 4:
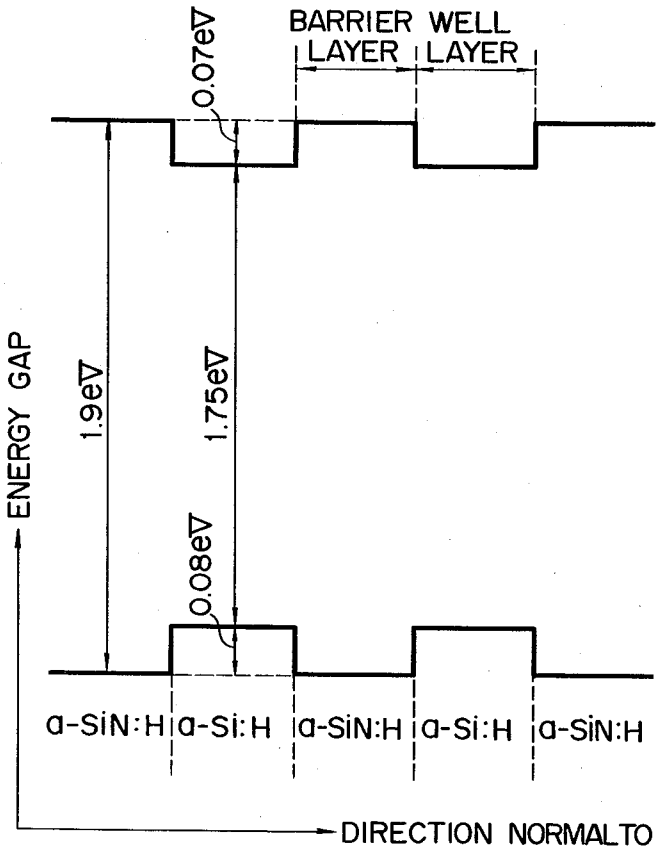

In this embodiment, in each of photoconductive layer 23 and charge-generation layer 26, as is best illustrated in an enlarged sectional view in FIG. 3, thin layers 31 and 32 are alternately stacked. Thin layers 31 and 32 have different optical bandgaps, and each layer has a thickness of 30 to 200 Å. Stacking of such thin films causes the quantum size effect. If the thickness is as great as 300 or 400 Å, only the potential modulation effect can be obtained by stacking. The physical properties of the resultant structure are, as it were, average values of the constituting layers. The direction of thickness (direction normal to surface) is plotted along the abscissa of an energy band chart of the super lattice structure of each of FIGS. 4 and 5, and the optical bandgap is plotted along the ordinate. For example, if thin layers 31 and 32 are a-Si:H and a-SiN:H, respectively, a-SiN:H has an optical bandgap of 1.9 eV and a-Si:H has an optical bandgap of 1.75 eV, as is shown in FIG. 4. The a-SiN:H layer serves as a potential barrier layer and the a-Si:H layer serves as a potential well layer. In this manner, when the a-Si:H and a-SiN:H layers are alternately stacked, a periodic potential well structure is constituted. If thin layers 31 and 32 are a-SiGe:H and a-Si:H layers, respectively, a-SiGe:H has an optical bandgap of 1.5 eV and a-Si:H has an optical bandgap of 1.75 eV, as is shown in FIG. 5. Therefore, the a-Si:H layer serves as a barrier layer, and the a-SiGe:H layer serves as a well layer. The a-Si:H layer of FIG. 4 serves as the well layer, while the a-Si:H layer of FIG. 5 serves as the barrier layer. In this manner, the thin layers having different optical bandgaps are stacked, to thereby constitute a super lattice structure, regardless of the size of the optical bandgaps. In the super lattice structure, the layer having a larger optical bandgap serves as a barrier, constituting a periodic potential barrier in relation to the layer having a smaller optical bandgap. Since the barrier thin layer of the structure is very thin, carriers can pass through the barrier and travel through the super lattice structure by means of the tunnel effect of the carriers through the thin layers. In such a super lattice structure, the number of carriers generated upon radiation is large. Therefore, the structure possesses a high sensitivity to light. By changing the film thicknesses and the bandgaps of the thin layers constituting the super lattice structure, the apparent bandgap of the layers constituting the heterojunction super lattice structure can be arbitrarily controlled.

0.01 to 30 atm %, preferably 1 to 25 atm % of hydrogen atoms H are contained in each of the a-Si:H, a-SiN:H, and a-SiGe:H layers, thereby compensating for silicon dangling bonds, so as to equally match the dark resistance with the bright resistance. As a result, the photoconductive characteristics can be improved. When the thin layer is formed by glow discharge decomposition, a silane gas such as $SiH_4$ and $Si_2H_6$ is supplied to a reaction chamber, and a glow discharge is generated by RF power, so that hydrogen atoms can be added to the thin layer. In order to form an a-SiN:H layer, an $N_2$ or $NH_3$ gas may be added in a predetermined amount. A gas mixture of $SiH_4$ and germane ($GeH_4$) is glow-discharged to form an a-SiGe:H layer. Hydrogen or helium gas may be used as a carrier gas for silanes, as required. A silicon halide gas such as $SiF_4$ or $SiCl_4$ gas may be used as a source gas. Although a gas mixture of a silane gas and silicon halide gas can be glow-discharged to form a-SiN:H and a-Si:H layers, the thin layer may alternatively be formed by a physical method, such as sputtering.

Barrier layer 22 serves to restrict the flow of charge between conductive substrate 21 and photoconductive layer 23 (or charge-generating layer 25), whereby the charge-retaining capability on the surface of the photoreceptor can be increased, and hence, the charging capacity of the photoreceptor can be increased. In order to positively charge the surface of the photoreceptor, using an electrophotographic method based on the Carlson system, a p-type barrier layer is used to prevent electrons from being injected from the substrate to the photoconductive layer. However, in order to negatively charge the surface of the photoreceptor, an n-type barrier layer is used to prevent holes from being injected from the substrate to the photoconductive layer. The barrier layer may be formed on an insulating layer formed on the substrate. Microcrystalline silicon (to be referred to as μc-Si hereinafter) may be used for barrier layer 22. The barrier layer may be formed, using a-Si:H. The thickness of barrier layer 22 is preferably 100 Å to 10 μm.

The μc-Si layer is clearly distinguished from a-Si:H and polycrystalline silicon layers, by the following physical properties:

In X-ray diffraction measurement, a-Si:H is amorphous, and only a halo appears. In other words, a clear diffraction pattern cannot be found.

On the other hand, μc-Si presents a crystalline diffraction pattern at $2\theta$ of 28 to 28.5 degrees. Polycrystalline silicon has a dark resistivity of $10^6$ Ω. cm, while μc-Si can be controlled to show a dark resistivity of $10^{10}$ Ω.cm or more. The μc-Si layer is made of a mixture of phases of microcrystalline and amorphous silicon particles each of which has a particle size of about several tens of angstroms.

The photoconductive layer containing μc-Si can be prepared in the same manner as a-Si:H, by RF glow discharge decomposition using silane gas as a source gas, such that μc-Si:H is deposited on a conductive substrate. In this case, the substrate temperature and RF power are higher than that in the formation of a-Si:H layer, thereby easily forming the μc-Si:H layer. When the support temperature and the RF power are increased, the flow rate of the source gas, such as silane gas, can be increased, resulting in a faster film formation rate. A gas obtained by diluting a higher silane gas, such as $SiH_4$ or $Si_2H_6$, with hydrogen gas may be used to form μc-Si:H at a higher rate.

In order to obtain p-type μc-Si:H and a-Si:H, it is preferable to dope an element (e.g., boron B, aluminum Al, gallium Ga, indium In, and thallium Tl) contained in Group III of the Periodic Table. In order to obtain n-type μc-Si:H, it is preferable to dope an element (e.g., nitrogen N, phosphorus P, arsenic As, antimony Sb, and bismuth Bi) contained in Group V of the Periodic Table. Upon doping of the p- or n-type impurity, the transfer of charge from the substrate to the photoconductive layer can be prevented. When at least one element selected from the group consisting of carbon C, nitrogen N, and oxygen O is contained in μc-Si:H or a-Si:H, an insulating barrier layer having a high resistance can be formed.

Surface layer 24 is formed on photoconductive layer 23 or charge-generation layer 26. Since a-Si:H in photoconductive layer 23 or charge-generation layer 26 has a high refractive index of 3 to 3.4, light tends to be reflected on their respective the surfaces. As reflection of light reduces the amount of light absorbed in the photoconductive layer or the charge-generating layer, light loss is consequently increased. For this reason, it is preferable to form surface layer 24 in such a way as to prevent such reflection. Formation of surface layer 24 also prevents layer 23 or 26 from being damaged, and improves the charging capacity, allowing a good charge distribution on the surface. Materials for forming the covering layer are an inorganic compound (e.g., a-SiN:H, a-SiO:H, and a-SiC:H) and an organic compound (e.g., polyvinyl chloride or polyamide).

Figure 7:
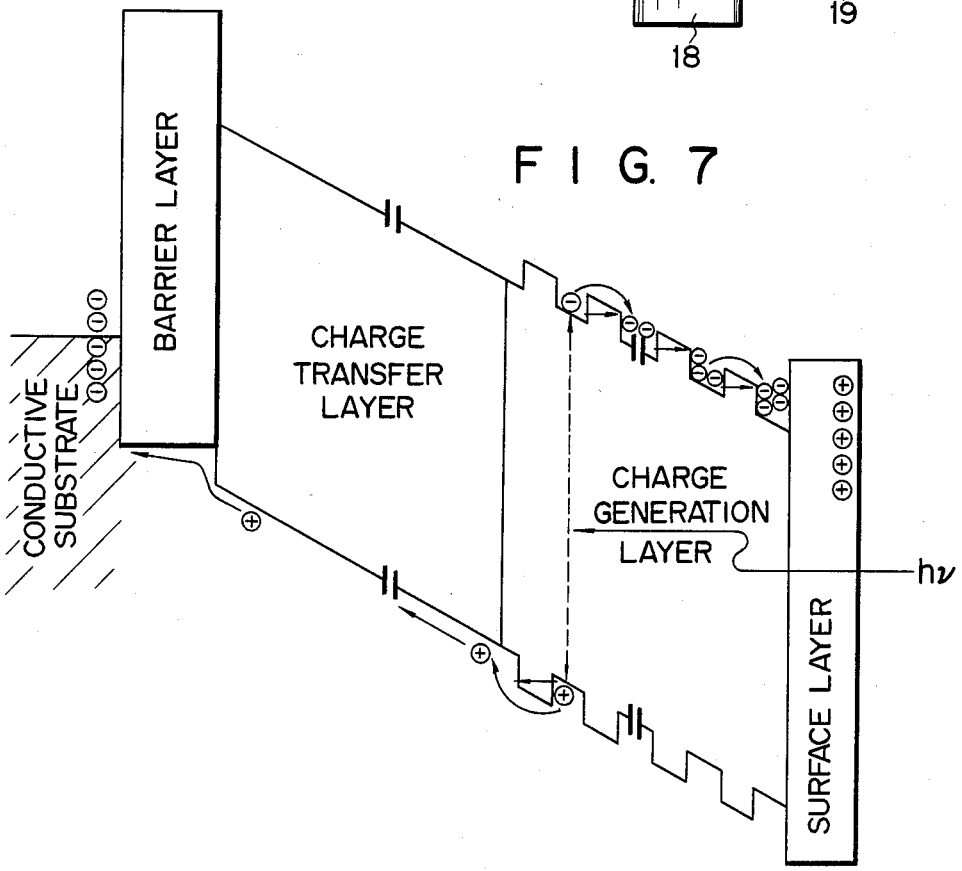
FIG. 7 is a chart showing an energy gap of a photoreceptor.

When the surface of the electrophotographic photoreceptor having the construction described above is positively charged with about 500 V, by means of corona discharge, a potential barrier (FIG. 7) can be obtained in the function-separation type electrophotographic photoreceptor shown in FIG. 2. When light ($h\nu$) is incident on this photoreceptor, electrons and holes, as carriers, are generated in the super lattice structure of chargegeneration layer 26. The electrons in the conduction band are accelerated by an electric field in the photoreceptor, and travel toward surface layer 24. The holes are accelerated toward conductive support 21. The number of carriers generated at the interface of the thin layers having different optical bandgaps is far greater than that of carriers generated in the bulk. For this reason, the super lattice structure has a high sensitivity to light. In the potential well layer, carrier lifetime is prolonged five to ten times that in the single layer without a super lattice structure, due to the quantum effect. In the super lattice structure, a periodic barrier layer is formed by bandgap discontinuity. However, since the carriers can pass through the barrier layer because of the tunnel effect, the effective mobility of the carriers is substantially the same as that in the bulk, and the carriers can be efficiently transferred. As is described above, according to the super lattice structure obtained by stacking the thin layers having different optical bandgaps, good photoconductive characteristics can be obtained, to thereby provide a clearer image as compared with the conventional photoreceptor.

Figure 6:
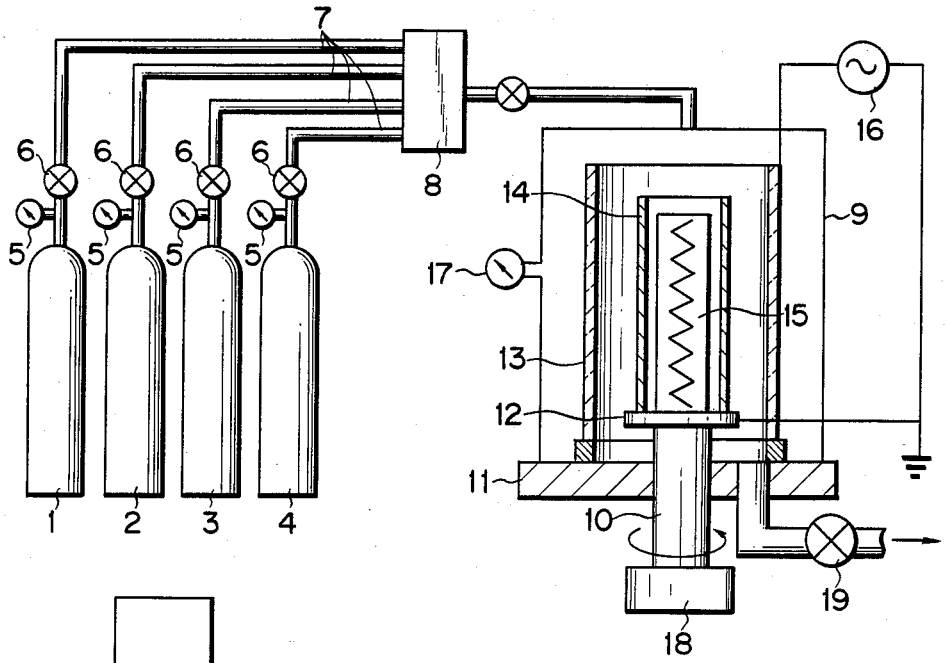
FIG. 6 is a schematic view showing an apparatus for manufacturing the electrophotographic photoreceptors of these embodiments.

FIG. 6 shows an apparatus for manufacturing an electrophotographic photoreceptor according to the present invention, utilizing the glow discharge method. Gas cylinders 1, 2, 3, and 4 store source gases such as $SiH_4$, $B_2H_6$, $H_2$, and $CH_4$. Gases in cylinders 1, 2, 3, and 4 can be supplied to mixer 8, through flow control valves 6 and pipes 7 respectively. Each cylinder has pressure gage 5. The operator controls each valve 6 while monitoring corresponding pressure gage 5, thereby controlling the flow rate of each gas and their mixing ratio. The gas mixture is supplied from mixer 8 to reaction chamber 9. Rotating shaft 10 extends vertically extends from bottom 11 of reaction chamber 9, and can be rotated about the vertical axis. Disk-like support table 12 is fixed on the upper end of shaft 10 such that the surface of table 12 is perpendicular to shaft 10. Cylindrical electrode 13 is arranged inside chamber 9 such that the axis of electrode 13 is aligned with the axis of shaft 10. Drum-like substrate 14 for a photoreceptor is placed on table 12 such that the axis of the former is aligned with the axis of shaft 10. Drum-like substrate heater 15 is arranged inside substrate 14. RF power source 16 is connected between electrode 13 and substrate 14, and supplies an RF current therebetween. Rotating shaft 10 is driven by motor 18. The internal pressure of reaction chamber 9 is monitored by pressure gage 17, and chamber 9 is connected to a proper evacuating means, such as a vacuum pump, through gate valve 18.

In order to manufacture a photoreceptor in the apparatus having the construction described above, drum-like substrate 14 is placed in reaction chamber 9, and gate valve 19 is opened to evacuate chamber 9 to a vacuum of about 0.1 Torr or less. The predetermined gases from cylinders 1, 2, 3, and 4 are supplied to chamber 9, at a predetermined mixing ratio. In this case, the flow rates of the gases supplied to chamber 9 are determined such that the internal pressure of chamber 9 is set to be 0.1 to 1 Torr. Motor 18 is operated to rotate substrate 14. Substrate 14 is heated to a predetermined temperature by heater 15, and an RF current is supplied between electrode 13 and substrate 14, thereby generating a glow discharge therebetween. An a-Si:H layer is deposited on substrate 14. $N_2O$ , $NH_3$, $NO_2$, $N_2$, $CH_4$, $C_2H_4$, and $O_2$ gases and the like may be added to the feed gas to add the element N, C, or O in the a-Si:H layer.

As is apparent from the above description, the electrophotographic photoreceptor according to the present invention can be manufactured in a closed-system manufacturing apparatus, thus guaranteeing the safety of the operators. Since the electrophotographic photoreceptor has high resistance to heat, to humidity, and to wear, repeated use thereof does not result in degradation; thus, a long service life is assured.

Electrophotographic photoreceptors according to the present invention were formed, and their electrophotographic characteristics were tested in the following manner.

EXAMPLE 1

A drum-like aluminum substrate having a diameter of 80 mm and a width of 350 mm was treated with an acid and an alkali, and then sand-blasted to prevent an optical interference. The substrate was placed in the reaction chamber, which was then evacuated to a vacuum of about $10^{-5}$ Torr. The substrate was heated to 250° C. and rotated about its axis, at a speed of 10 rpm. At the same time, $SiH_4$ gas having a flow rate of 500 SCCM, $B_2H_6$ gas having a flow rate ratio of $10^{-6}$ with respect to $SiH_4$ gas, and $CH_4$ gas having a flow rate of 100 SCCM were supplied into the reaction chamber, to set the internal pressure thereof at 1 Torr. RF power of 13.56-MHz was applied to generate a plasma, thereby forming a p-type a-SiC:H barrier layer.

Subsequently, the $B_2H_6/SiH_4$ ratio was set to be $10^{-7}$, and the flow rate of $CH_4$ gas to be zero. RF power of 500 W was supplied to form a 20-μm thick i-type a-Si:H charge transfer layer.

The discharge was temporarily interrupted, and $NH_3$ gas having a flow rate of 120 SCCM was supplied to the reaction chamber, to set the reaction pressure at 1.2 Torr. RF power of 500 W was supplied, to thereby form a thin (50 Å) a-SiN:H layer. Subsequently, the flow rate of the $SiH_4$ gas was set to 500 SCCM, and the $B_2H_6/SiH_4$ ratio was set to $10^{-7}$. RF power of 500 W was applied, to form a 50-Å a-Si:H layer. The above operations were repeated to alternately stack 250 thin a-SiN:H layers and 250 thin a-Si:H layers, to prepare a 5-μm thick charge-generation layer having a heterojunction super lattice structure. Subsequent to this, a 0.5-μm thick a-SiC:H surface layer was formed.

The surface of the resultant photoreceptor was positively charged at about 500 V, and white light was irradiated thereon. Light was absorbed by the charge-generation layer, and a large number of electron-hole pairs were generated, as carriers. In Example 1, a large number of carriers was generated, the carrier lifetime was longer than in the prior art receptor, and the carriers were transferred effectively. As a result, a clear, high-quality image could be obtained. Even if the photoreceptor was repeatedly charged, the transfer image had good reproducibility and stability. In addition, the photoreceptor was found to have good durability properties such as high resistance to corona, to humidity, and to wear.

EXAMPLE 2

Following the same procedures as in Example 1, a p-type a-SiC:H barrier layer and an i-type a-Si:H charge transport layer were formed. Thereafter, the flow rate of $GeH_4$ gas was set to 200 SCCM, and the reaction pressure was set to 1.2 Torr. RF power of 500 W was supplied, to thereby form a thin (50 Å) a-Si:H layer. Also, following the same procedures as in Example 1, a thin (50 Å) a-Si:H layer was formed. The above operations were repeated to alternately stack 250 thin a-SiGe:H layers and 250 thin a-Si:H layers, thereby forming a 5-μm thick charge-generation layer having a heterojunction super lattice structure. Thereafter, a 0.5-μm a-SiC:H surface layer was formed.

The resultant photoreceptor had high sensitivity at long wavelengths of 780 to 790 nm, which is an oscillation wavelength of a semiconductor laser. A semiconductor laser printer where the photoreceptor was built can form an clear image, and had a high resolution even when the exposure on the surface of the photoreceptor was 25 erg/cm$^2$.

Even when the photoreceptor was repeatedly charged, it had good reproducibility and stability of the transfer image, and had good durability properties such as high resistance to corona, to humidity, and to wear.

In Examples 1 and 2, the thickness of the charge-generation layer was 5 μm. However, the thickness may be reduced to 1 or 3 μm. Furthermore, the thin layers are not limited to a-Si:H, and a-SiN:H, and a-SiGe:H layers. The thin films are not limited to two types; three or more types of thin layers may be stacked alternately. In this case, it is essential to form an interface of thin layers having different optical bandgaps.

According to the embodiment of the present invention, the super lattice structure, wherein thin layers having different optical bandgaps are stacked, is used in part or in all of the photoconductive layer. Therefore, the photoreceptor has a high sensitivity in the range from visible light to near-infrared components of long wavelengths, has a high resistance and good charging properties. In particular, by properly combining the materials constituting the thin layers, a specific photoreceptor having optimal photoconductive properties in regard to light having a specific wavelength range can be advantageously obtained.

What is claimed is:

1. An electrophotographic photoreceptor which generates an image in response to the application of light comprising:

a conductive substrate;

a photoconductive layer having an electrically charged surface and a super lattice structure; and photocarriers of two different polarities in said photoconductive layer generated by said application of light, wherein more of the photocarriers having one polarity are neutralized by the electric charge on the surface of the photoconductive layer to produce a static latent image.

2. A photoreceptor according to claim 1, wherein the super lattice structure comprises a structure obtained by alternately stacking thin layers of at least two types of amorphous semiconductors.

3. A photoreceptor according to claim 2, wherein the thin layers have different optical bandgaps.

4. A photoreceptor according to claim 3, wherein the thin layers have a thickness range of 30 to 200 Å.

5. A photoreceptor according to claim 1, wherein said thin layers comprise amorphous silicon containing hydrogen.

6. A photoreceptor according to claim 5, wherein the thin layers contain at least one element selected from the group consisting of carbon, oxygen, and nitrogen.

7. A photoreceptor according to claim 1, further comprising a barrier layer formed between the photoconductive layer and the conductive substrate, and a surface layer formed on the photoconductive layer.

8. A photoreceptor according to claim 1, wherein the photoconductive layer comprises a charge-generation layer obtained by stacking the thin layers, and a charge-transfer layer for transferring the charge toward the conductive substrate.

9. A photoreceptor according to claim 7, wherein the barrier layer comprises microcrystalline silicon.

10. A photoreceptor according to claim 2, wherein said photoconductive layer comprises thin films of amorphous silicon containing hydrogen and thin films of amorphous silicon containing hydrogen and nitrogen, which layers are alternately stacked.

11. An electrophotographic photoreceptor according to claim 3 wherein the layer having the larger optical bandgap constitutes a periodic potential barrier in relation to the layer having the smaller optical bandgap.

12. An electrophotographic photoreceptor according to claim 5 wherein from 0.01 to 30 atm % of hydrogen atoms are contained in said amorphous silicon containing layers.

13. An electrophotographic photoreceptor according to claim 3 wherein the thin layers have a thickness range of from 30 to 100 Angstroms.

* * * * *